US007857000B1

(12) United States Patent
Langdon

(10) Patent No.: US 7,857,000 B1
(45) Date of Patent: Dec. 28, 2010

(54) GARDEN WATER HOSE ASSEMBLY

(76) Inventor: Dess Langdon, 130 Popes Lake Rd., Angier, NC (US) 27501

( * ) Notice: Subject to any disclaimer, the term of this patent is extended or adjusted under 35 U.S.C. 154(b) by 578 days.

(21) Appl. No.: 11/678,217

(22) Filed: Feb. 23, 2007

(51) Int. Cl.
*B65H 75/34* (2006.01)

(52) U.S. Cl. ..... 137/355.27; 242/399.2

(58) Field of Classification Search ..... 137/355.2, 137/355.26, 355.27; 248/75, 80, 87; 239/195, 239/197, 273, 276, 279, 280, 280.5, 285; 242/399.2
See application file for complete search history.

(56) References Cited

U.S. PATENT DOCUMENTS 2,413,813 A * 1/1947 Decker ..... 248/87
2,964,258 A * 12/1960 Kutil ..... 242/399.2
3,184,180 A * 5/1965 Rockwell ..... 242/399.2
4,278,257 A * 7/1981 Garcia et al. ..... 242/399.2
5,205,521 A 4/1993 Smith
5,330,121 A * 7/1994 Eley ..... 242/399.2
5,390,695 A 2/1995 Howard
5,462,298 A * 10/1995 Bodine ..... 242/399.2
5,704,900 A * 1/1998 Dobrovolny et al. ..... 600/229
5,988,207 A * 11/1999 Kownacki et al. ..... 137/355.27
5,996,142 A * 12/1999 Colman ..... 4/615
6,478,265 B2 11/2002 Leach
7,150,425 B2 * 12/2006 Banaszkiewicz et al. . 242/385.3

* cited by examiner

*Primary Examiner*—John Fox
(74) *Attorney, Agent, or Firm*—Coats & Bennett, PLLC

(57) ABSTRACT

A garden hose assembly is provided which includes a protective and decorative housing at least partially enclosing a hose reel assembly. The housing is rotatable fully 360 degrees about a supporting post. Water is supplied to the assembly through a connector mounted on the post. Water is conducted in a water supply line concealed entirely within the post and housing.

15 Claims, 5 Drawing Sheets

GARDEN WATER HOSE ASSEMBLY

FIELD OF THE INVENTION

The present invention relates to the field of lawn and garden watering systems.

BACKGROUND

The ability to conveniently store and dispense garden watering hoses is important for many home and commercial gardening situations. It is common to find various forms of hose reel assemblies onto which a garden hose may be wound and stored and from which it may be dispensed for use. Typically, such devices are to be mounted onto the side of a structure such as a house or other building. In some cases they are found mounted on stands, either movable or fixed. In such cases, means to pivot the hose reel assembly are provided.

Water is commonly supplied to such devices using a water supply hose which often is attached directly to a coupling included in the hose reel assembly In some cases, the water supply hose may be connected to a control valve included as a part of the device.

A typical feature of such devices is that they are noticeable, sometimes to the extent of being unsightly in the garden environment. The general form or shape of the units makes them stand out not as a part of the aesthetically-pleasing environment of a garden but rather as a utility. Adding to the unsightliness is the ever present water supply hose draped from the unit.

There is a need for a garden water hose assembly that is neat and aesthetically appealing in a garden as well as convenient to use.

SUMMARY OF THE INVENTION

The present invention comprises a garden water hose assembly which includes a post to support a hose reel assembly and to provide for rotation of the hose reel assembly about an axis of the post. The post has an interior opening extending through at least a portion thereof. An inlet coupling is disposed on the post for connecting to a water hose which supplies water to the assembly. A water supply line connects to the inlet coupling. A first portion of the water supply line is disposed within the interior opening of the post and extends from the inlet coupling for supplying water to the hose reel assembly.

The present invention also comprises a garden hose assembly including a hose reel assembly for storing and dispensing hose and a housing extending at least partially around the hose reel assembly. The garden hose assembly further includes a post. The hose reel assembly and the housing are mounted for rotation about an axis of the post. The housing is ornamental and includes an openable portion that permits assess to the hose reel assembly.

Other objects and advantages of the present invention will become apparent and obvious from a study of the following description and the accompanying drawings which are merely illustrative of such invention.

DETAILED DESCRIPTION

Figure 1:
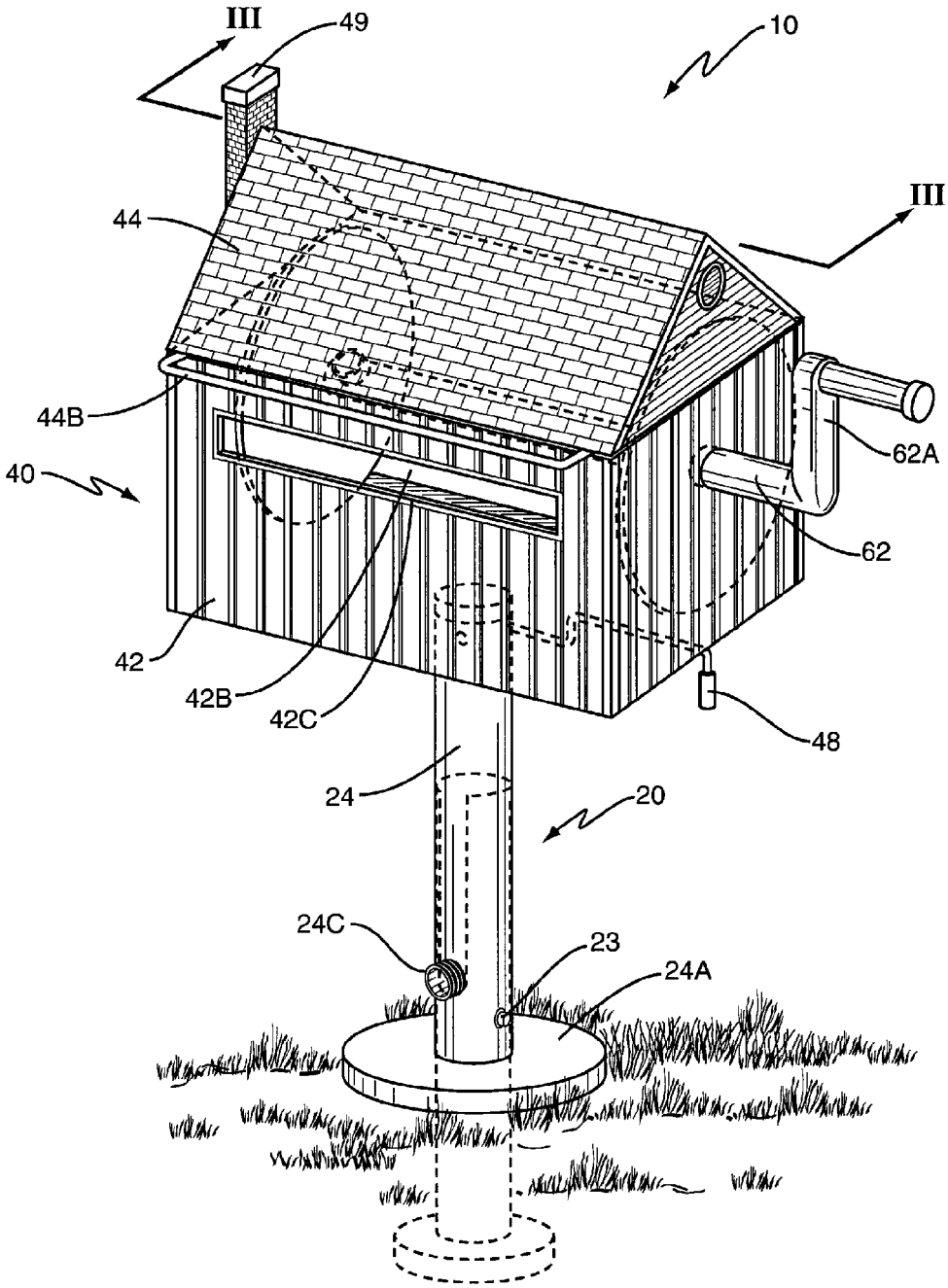
FIG. 1 is a perspective view of the garden hose assembly.

The garden water hose assembly, generally indicated in the drawings by the numeral 10, includes a post 20 and a housing 40 rotatably mounted to the post. In one embodiment, post 20 is implanted into the ground as shown in FIG. 1. Housing 40 at least partially encloses a hose and reel assembly 60 and is trimmed to provide an aesthetic appearance. In the embodiment shown the appearance provided is that of a bird house. A water supply line 80, shown in FIG. 3, connects to hose reel assembly 60 and extends within the interiors of housing 40 and post 20. In one embodiment, water hose 12 is connected to provide water to assembly 10. In other embodiments, water may be supplied to assembly 10 by means other than water hose 12.

Figure 3:
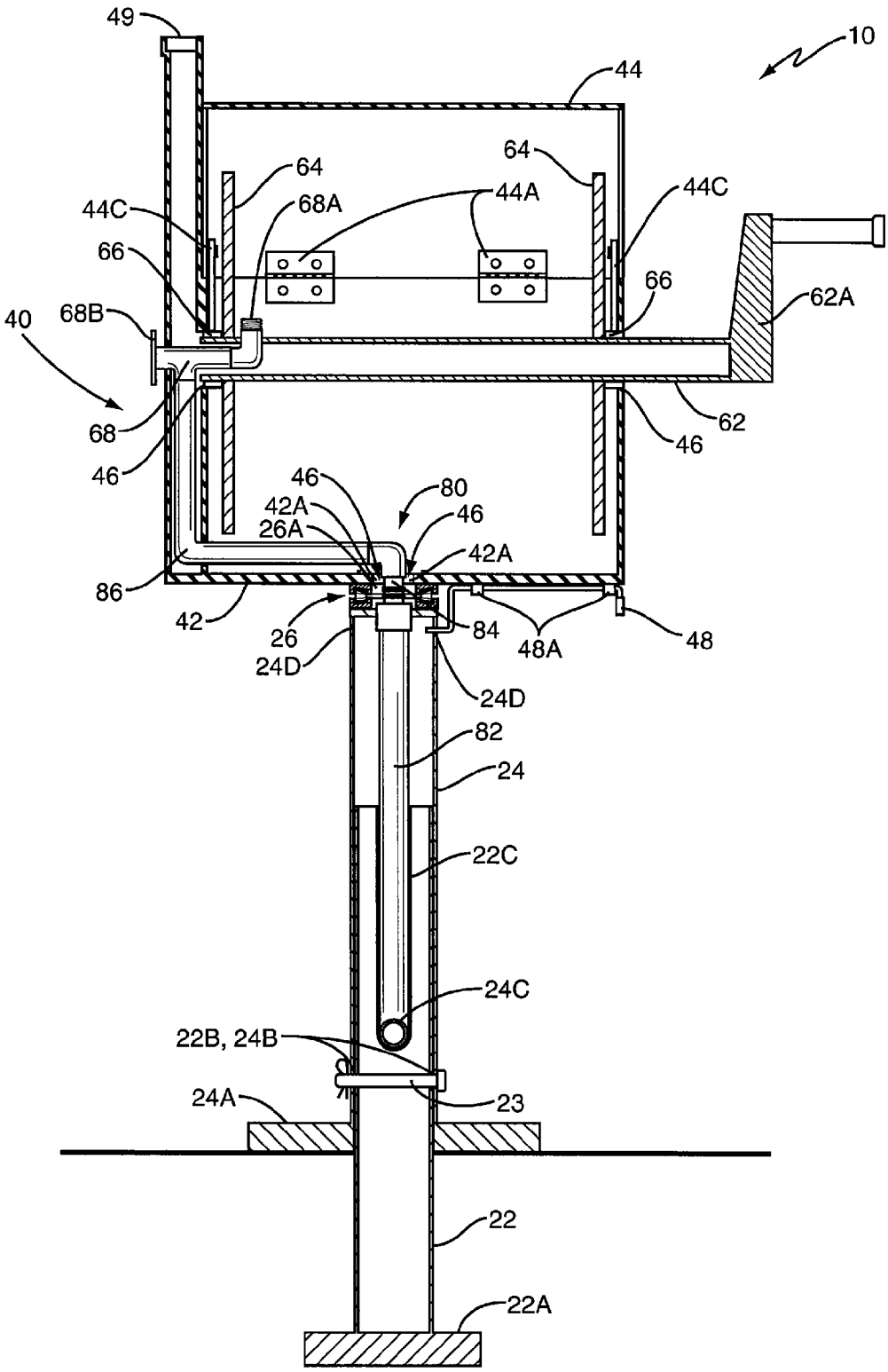
FIG. 3 is a front sectional view of the garden hose assembly.

Turning now to post 20 and referring specifically to FIG. 3, it is appreciated that the post comprises a first portion 22 that is partially enclosed within a second portion 24. First portion 22 of the post includes an anchor 22A. In one embodiment anchor 22A comprises a plate welded to first portion 22 as shown in the drawings. Disposed above anchor 22A are aligned holes 22B, the centerlines of which extend transversely across first portion 22 of post 20. Holes 22B align with holes 24B in second portion 24 of post 20. Connecting pin 23 is inserted through aligned holes 22B and 24B to affix second portion 24 of post 20 to first portion 22. Ground plate 24A is disposed below holes 24B, and in one embodiment the ground plate comprises a flange welded about second portion 24 of post 20. In one embodiment ground plate 24A is disposed atop the ground and contributes both to the stability of post 20 and the aesthetics of the installation.

Figure 2:
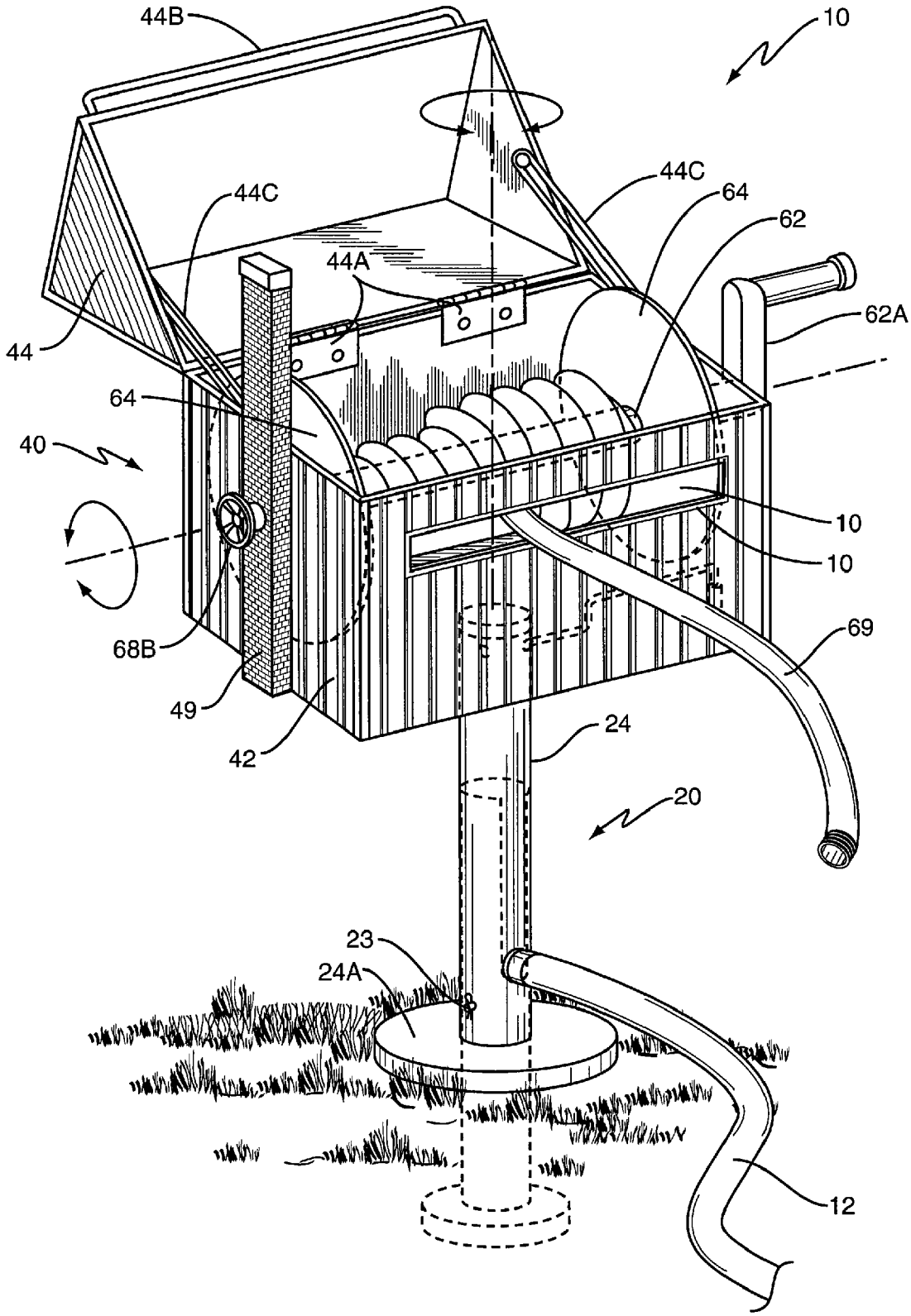
FIG. 2 is a perspective view of the garden hose assembly shown with the openable portion opened

It is appreciated that a feature of the present invention relates to routing water to hose reel assembly 60 up through the interior of post 20 and the interior of housing 40. In one embodiment, an inlet coupling 24C is disposed on second portion 24 of post 20, and a portion thereof extends into the interior of the second portion. See FIG. 3B. Slot 22C in first portion 22 of post 20 extends longitudinally on the first portion and is aligned with inlet coupling 24C as can be seen in the drawings and in particular in FIG. 3B. During assembly of post 20, slot 22C permits inlet coupling 24C to clear first portion 22 as second portion 24 is slid over the first portion to form post 20. In the embodiment shown in the drawings, water hose 12 connects to inlet coupling 24C to supply water to assembly 10 as can be seen in FIG. 2. As mentioned here before, water may be supplied to assembly 10 by means other than a water hose. In such cases, the placement of inlet coupling 24C may vary from that shown in FIG. 1.

Figure 3A:
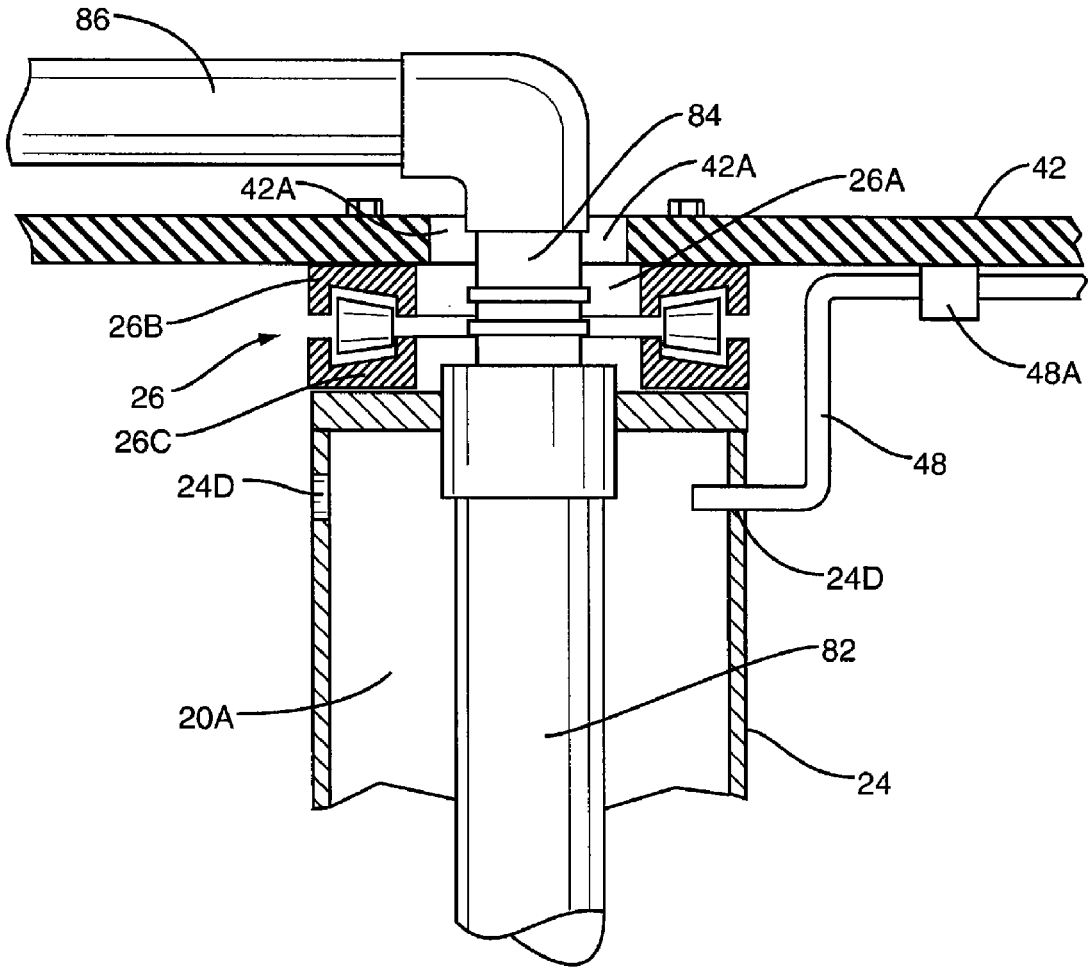
FIG. 3A is a fragmentary sectional front view of a portion of the garden hose assembly showing the rotating union and thrust bearing.
Figure 3B:
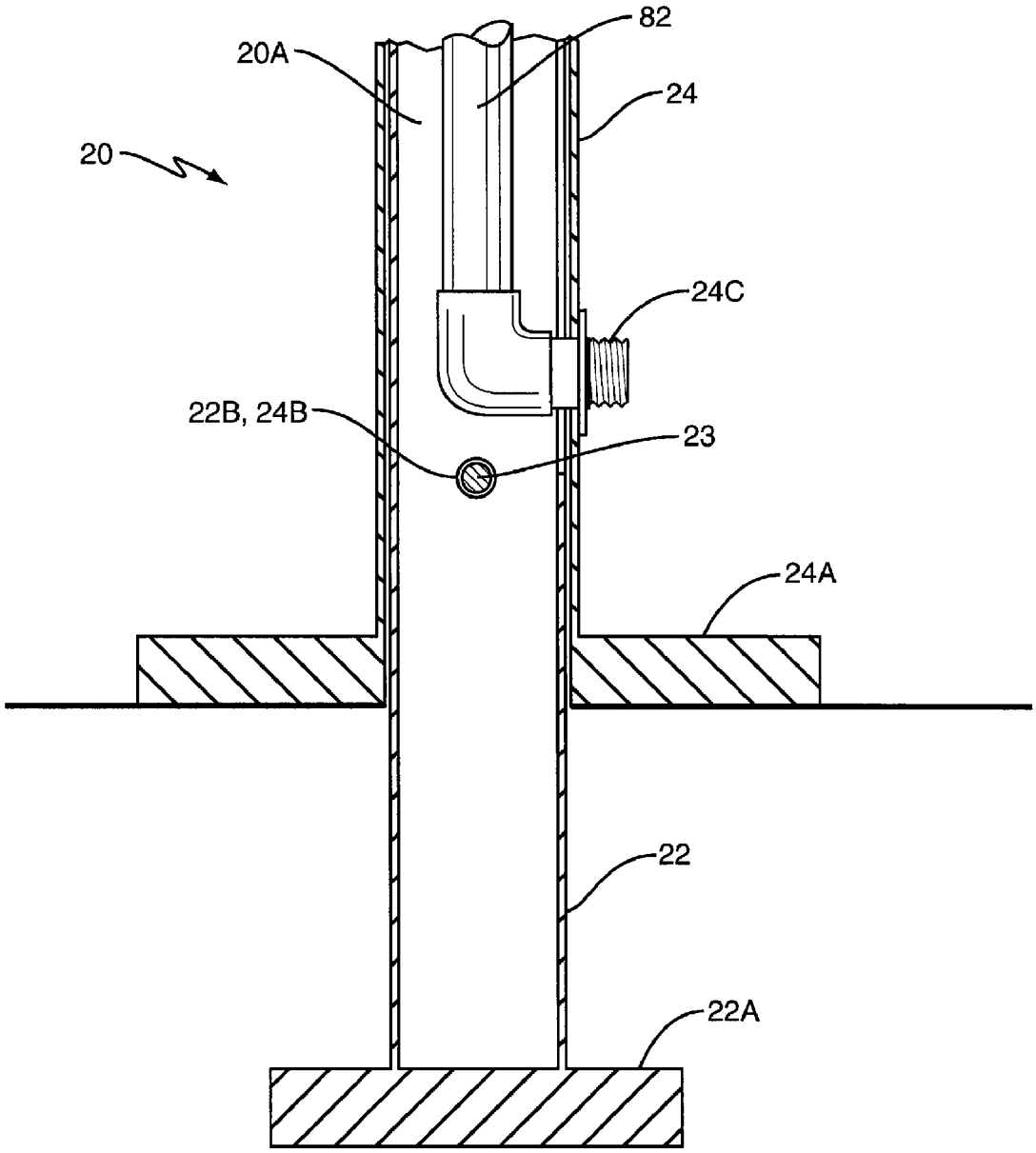
FIG. 3B is a fragmentary sectional side view of a portion of the garden hose assembly showing the water hose coupling and a portion of the water supply line.

Turning now more particularly to the means for conducting water within post 20, it is appreciated that a first portion 82 of water supply line 80 connects to inlet coupling 24C as can be seen in FIG. 3B. First portion 82 of water supply line 80 extends upwardly within the interior 20A of post 20 and connects to rotating union 84. In one embodiment first portion 82 of water supply line 80 comprises a PVC pipe. Connections between the PVC pipe and inlet coupling 24C as well as rotating union 84 may be made by any of various means known to those of ordinary skill in the art. Water may then be conducted from water hose 12, in one embodiment, through inlet coupling 24C, along first portion 82 of water supply line, and through rotating union 84. As will be discussed in more detail hereinafter, a second portion 86 of water supply line 80, disposed in housing 40, connects rotating union 84 and hose reel assembly 60 to conduct water to the hose reel assembly.

To facilitate 360 degree rotation of housing 40 about post 20, a thrust bearing 26 is disposed on second portion 24 of post 20. Thrust bearing 26 may, for example, comprise a roller thrust bearing of common design as shown in FIG. 3A. Thrust bearing 26 forms an annular ring-like structure having an interior opening 26A and upper and lower mounting sections 26B and 26C. Thrust bearing 26 is mounted to post 20 such that interior opening 26A of the thrust bearing aligns with interior opening 20A of the post to provide an opening through which water supply line 80—rotating union 84 in particular—extends. In one embodiment, rotating union 84 is disposed at least partially within interior opening 26A of thrust bearing 26. It is further appreciated that thrust bearing 26 provides for 360 degree rotation about the axis of the bearing while also stably securing together upper and lower mounting sections 26B and 26C against axial separation and transverse displacement.

As shown in the FIGS. 3 and 3A, thrust bearing 26 connects post 20 and housing 40. In particular, lower mounting section 26C is attached to post 20 while upper mounting section 26B is attached to housing 40. Said attachments may take various forms as commonly practiced in mechanism assembly. Bearing 26, however, provides ample stability to keep housing 40 attached securely to post 20. A mechanism is provided to lock the housing and prevent it from rotating when such is desired. To facilitate this locking mechanism, to be described in detail hereinafter, locking holes 24D are disposed in the second portion of the post below thrust bearings 26 as shown in the drawings and in particular in FIG. 3.

Turning now to a more detailed description of housing 40, the housing comprises a main body portion 42 and an openable portion 44 connected thereto by hinges 44A. Hinges 44A rotatably connect openable portion 44 to main body portion 42. Openable portion 44 includes a handle 44B to facilitate opening and closing housing 40. Sliding catches 44C connect between openable portion 44 and main body 42 to permit the openable portion to open to more than 90 degrees and as much as 135 degrees, and to be held open. Main body 42 also includes openings 46 to receive and support hose reel assembly 60 as will be described hereinafter. A hose feed opening 42B is disposed on main body 42 through which garden hose 69 extends. Hose feed opening 42B is lined with hose feed grommet 42C to provide a smooth surface against which garden hose 69 slides.

Housing 40 may be shaped and trimmed to provide an aesthetic appearance. In one embodiment, the housing is shaped and trimmed as a bird house, for example, as illustrated in the drawings. Openable portion 44 forms a roof-like structure and in one embodiment a chimney-like structure 49 may be added Turning now to particulars regarding connecting housing 40 to post 20, it is appreciated that the housing is rotatably connected to the post in a manner to allow water supply line 80 to extend from within the post to within the housing. Main body portion 42 includes a water supply opening 42A disposed generally in the center of a lower portion of the body as shown in FIGS. 3 and 3A. Water supply opening 42A is aligned with thrust bearing interior opening 26A. Rotating union 84 extends from interior opening 20A of post 20 partially into, or towards, water supply opening 42A. A second portion 86 of water supply line 80 is disposed within the housing and connected to rotating union 84 and hose reel assembly 60 as will be discussed further hereinafter.

A locking pin 48 is disposed on the main body to facilitate locking housing 40 to post 20 when rotation of the housing is not desired. Rotation may not be desired, for example, when watering with a garden hose 69 in a limited area. It may also be desirable for aesthetic or safety reasons to lock the housing in a particular orientation when garden water hose assembly 10 is not in use. In one embodiment, locking pin 48 is slidably connected to an underside of the main body 42. The slidable connection is provided by aligned guide tabs 48A, each of which includes a hole within which locking pin 48 slides. When locking is desired, housing 40 is rotated to a position in which locking pin 48 aligns with one of the locking holes 24D disposed on post 20, and the locking pin is pushed into engagement with the hole. Housing 40 may be subsequently unlocked by retracting locking pin 48 thereby allowing free rotation of the housing.

As mentioned here before, hose reel assembly 60 is at least partially enclosed by housing 40 as shown in FIG. 3. Hose reel assemblies are common and exist in various forms. In the example shown in FIG. 3, hose reel assembly 60 comprises a reel 62 and crank arm 62A. Reel guards 64 are affixed to reel 62 in a spaced apart fashion and bushings 66 provide means to connect the hose reel assembly to openings 46 in housing 40. A water connector union 68 is disposed at least partially within reel 62. Water connector union 68 provides a rotatable water path between the union and a hose connector 68A which is a part thereof, permitting the hose reel 62 to rotate while paying out and reeling in a garden nose. A water control valve 68B may be included with the hose reel assembly as a part of, or appurtenant to, the water connector union 68. A garden hose 69 is connected to hose connector 68A of water connector union 68. It is appreciated that by turning crank arm 62, garden hose 69 may be wound onto reel 62. Further, by pulling garden hose 69 the hose may be de-reeled for use. As can be seen in FIG. 3, hose reel assembly 60 is supported in housing 40 by attachment of bushings 66 with the housing. The attachment may be of various commonly known means.

Also disposed within housing 40 and connected to hose reel assembly 60 is second portion 86 of water supply line 80, as has been previously mentioned. Second portion 86 of water supply line 80 connects to rotating union 84 thereby completing the assembly of the water supply line. Second portion 86 of the water supply line also connects to water connector union 68 of the hose reel assembly. In one embodiment, second portion 86 may be constructed of PVC pipe and fittings as shown in FIG. 3.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A garden hose assembly, comprising:

a. an elongated post having a longitudinal axis and having an interior opening extending through at least a portion of the elongated post;

b. an inlet coupling disposed on the post for connecting to a water hose;

c. a housing mounted to a top portion of the post and including an open interior area;

d. a rotary coupling operatively connected to both the post and the housing and which connects the housing to the top portion of the post such that the housing can rotate about the longitudinal axis of the post;

e. a hose reel rotatively mounted in the interior of the housing and rotatable about an axis extending through the housing; and;

f. a water supply line connected to the inlet coupling and extending upwardly through the interior opening within the elongated post, the water supply line including a first portion that extends generally from the inlet coupling to the rotary coupling and a second portion that extends from the rotary coupling to the hose reel and wherein, the second portion of the water supply line is rotatable with the housing as the housing rotates about the longitudinal axis of the post.

2. The garden water hose assembly of claim 1 wherein the hose reel assumes a generally horizontal orientation within the interior of the housing and rotates about a horizontal axis that extends through the housing; and wherein the second portion of the water supply line, after passing through the rotary coupling, turns and extends generally horizontally under the hose reel and after extending horizontally under the hose reel turns and extends vertically upwardly through the interior of the housing to where the second portion of the water supply line connects to a side portion of the hose reel.

3. The garden hose assembly of claim 1 wherein the rotary coupling includes a thrust bearing that connects the housing to the top portion of the post and wherein the thrust bearing includes an upper portion secured to a bottom portion of a housing, and wherein the thrust bearing includes a lower portion connected to the top portion of the post that the upper portion of the thrust bearing can rotate with respect to the lower portion of the thrust bearing.

4. The garden water hose assembly of claim 1 wherein the housing includes a top that is movable between an opened and closed position and when disposed in the open position exposes the hose reel which extends transversely across the interior of the housing such that a hose coiled around the hose reel is exposed along a length of the hose reel; and wherein the housing includes one or more sides and wherein one side includes an elongated opening formed therein, that permits the hose to be extended from the hose reel through the elongated opening in the side of the housing.

5. The garden water hose assembly of claim 1 including a locking assembly for locking the housing to the post such that the housing is prevented from rotating about the longitudinal axis of the post.

6. The garden water hose assembly of claim 1, wherein the post comprises a first portion and second portion and wherein the first portion is inserted substantially into the second portion such that the second portion surrounds a substantial portion of the first portion; and wherein the first portion of the post includes an elongated slot formed in an outer wall of the first portion and wherein the elongated slot extends generally parallel with the longitudinal axis of the elongated post.

7. The garden water hose assembly of claim 6 including a connecting pin for connecting the first portion of the post to the second portion of the post by aligning a hole in the first portion with a hole in the second portion and inserting the connecting pin through the two holes.

8. The garden water hose assembly of claim 1 wherein the hose reel assumes a generally horizontal orientation within the interior of the housing and rotates about a horizontal axis that extends through the housing; and wherein the second portion of the water supply line, after passing through the rotary coupling, turns and extends generally horizontally under the hose reel and after extending horizontally under the hose reel turns and extends vertically upwardly through the interior of the housing to where the second portion of the water supply line connects to a side portion of the hose reel; and wherein the rotary coupling includes a thrust bearing that connects the housing to the top portion of the post and wherein the thrust bearing includes an upper portion secured to a bottom portion of a housing, and wherein the thrust bearing includes a lower portion connected to the top portion of the post that the upper portion of the thrust bearing can rotate with respect to the lower portion of the thrust bearing.

9. The garden water hose assembly of claim 8, wherein the post comprises a first portion and second portion and wherein the first portion is inserted substantially into the second portion such that the second portion surrounds a substantial portion of the first portion; and wherein the first portion of the post includes an elongated slot formed in an outer wall of the first portion and wherein the elongated slot extends generally parallel with the longitudinal axis of the elongated post; and including a connecting pin for connecting the first portion of the post to the second portion of the post by aligning a hole in the first portion with a hole in the second portion and inserting the connecting pin through the two holes.

10. The garden hose assembly of claim 1 wherein the hose reel includes an elongated shaft that extends transversely through the interior area of the housing such that the hose reel is oriented generally horizontally in the housing; a pair of laterally spaced reel guards secured to the shaft of the hose reel; wherein the shaft of the hose reel includes an extension that extends through a side that forms a part of the housing; and a handle secured to the shaft extension outside of the housing for rotating the hose reel.

11. The garden hose assembly of claim 10 wherein the elongated shaft of the hose reel is hollow and wherein the second portion of the water supply line extends into the hollow shaft of the hose reel.

12. A garden hose assembly, comprising:

a. an elongated post having a longitudinal axis and having an interior opening extending through at least a portion of the elongated post;

b. an inlet coupling disposed on the post for connecting to a water hose;

c. a housing mounted to a top portion of the elongated post;

d. the housing including a bottom, a sidewall structure, a top that is movable between open and closed positions and wherein there is an interior area defined within the housing;

e. a hose reel assembly rotatively mounted in the interior area of the housing, the hose reel assembly including:

i) a transverse elongated rotating shaft that extends through the interior area of the housing;

ii) a pair of laterally spaced reel guards secured to the rotating shaft of the hose reel assembly and extending outwardly therefrom;

iii) the rotating shaft including a shaft extension that extends from the interior of the housing through a sidewall structure of the housing and includes a portion that extends on the exterior of the housing;

iv) a handle secured to the shaft extension exteriorly of the housing such that by rotating the handle the hose reel assembly can be rotated within the housing; and f. a water supply line connected to the inlet coupling and extending upwardly through the interior opening within the elongated post, the water supply line including a first portion that extends generally from the inlet to the housing and a second portion that extends through the interior area of the housing and is operatively connected to the hose reel assembly.

13. The garden hose assembly of claim 12 wherein the elongated shaft of the hose reel assembly is hollow and wherein the second portion of the water supply line includes a section that projects into the hollow rotating shaft of the hose reel assembly such that water directed through the water supply line passes through a portion of the hollow rotating shaft of the hose reel assembly.

14. The garden hose assembly of claim 13 including a rotary coupling operatively connected to both the post and the housing and which connects the housing to the top portion of the post such that the housing can rotate about the longitudinal axis of the post.

15. The garden hose assembly of claim 14 wherein the rotary coupling includes a thrust bearing that connects the housing to the top portion of the post and wherein the thrust bearing includes an upper portion secured to a bottom portion of a housing, and wherein the thrust bearing includes a lower portion connected to the top portion of the post that the upper portion of the thrust bearing can rotate with respect to the lower portion of the thrust bearing.

* * * * *